US011848138B2

(12) United States Patent
Tei

(10) Patent No.: US 11,848,138 B2
(45) Date of Patent: Dec. 19, 2023

(54) COIL COMPONENT AND METHOD FOR MANUFACTURING COIL COMPONENT

(71) Applicant: Murata Manufacturing Co., Ltd., Kyoto-fu (JP)

(72) Inventor: Hiroyuki Tei, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 1222 days.

(21) Appl. No.: 16/243,974

(22) Filed: Jan. 9, 2019

(65) Prior Publication Data

US 2019/0237234 A1 Aug. 1, 2019

(30) Foreign Application Priority Data

Jan. 30, 2018 (JP) ..... 2018-014093

(51) Int. Cl.

| | |
|---|---|
| ***H01F 27/28*** | (2006.01) |
| ***H01F 17/04*** | (2006.01) |
| ***H01F 27/26*** | (2006.01) |
| ***H01F 27/245*** | (2006.01) |
| ***H01F 27/29*** | (2006.01) |
| ***H01F 41/02*** | (2006.01) |
| ***H01F 41/064*** | (2016.01) |

(Continued)

(52) U.S. Cl.

CPC ..... *H01F 27/245* (2013.01); *H01F 3/14* (2013.01); *H01F 17/045* (2013.01); *H01F 27/263* (2013.01); *H01F 27/2823* (2013.01); *H01F 27/29* (2013.01); *H01F 41/0233* (2013.01); *H01F 41/064* (2016.01); *H01F 2017/0093* (2013.01)

(58) Field of Classification Search

CPC ..... H01F 27/245; H01F 27/2823; H01F 27/29
USPC ..... 336/221
See application file for complete search history.

(56) References Cited

U.S. PATENT DOCUMENTS 6,242,996 B1 * 6/2001 Sato ..... H01F 17/045 336/200
6,348,850 B1 * 2/2002 Kimura ..... H01F 17/045 336/200

(Continued)

FOREIGN PATENT DOCUMENTS

CN 107045915 A 8/2017
JP 2003-086442 A 3/2003

(Continued)

OTHER PUBLICATIONS

An Office Action; "Notification of Reasons for Refusal," mailed by the Japanese Patent Office dated Mar. 17, 2020, which corresponds to Japanese Patent Application No. 2018-014093 and is related to U.S. Appl. No. 16/243,974 with English language translation.

*Primary Examiner* — Marlon T Fletcher
*Assistant Examiner* — Joselito S. Baisa
(74) *Attorney, Agent, or Firm* — Studebaker & Brackett PC

(57) ABSTRACT

A coil component includes a drum core including a winding core portion and flange portions on opposite sides of the winding core portion in its axial direction, a wire wound around the winding core portion, and a sheet core arranged on a top surface of each of the flange portions and on the wire with an adhesive interposed therebetween. The adhesive contains no filler. A shortest distance between the top surface of the flange portion and the sheet core is not smaller than about 3 μm.

14 Claims, 3 Drawing Sheets

(51) Int. Cl.
*H01F 3/14* (2006.01)
*H01F 17/00* (2006.01)

(56) References Cited

U.S. PATENT DOCUMENTS 6,373,366 B1 * 4/2002 Sato ..... H01F 27/292 336/200
6,965,289 B2 * 11/2005 Toi ..... H01F 27/36 336/200
7,212,093 B2 * 5/2007 Singu ..... H01F 17/045 336/83
7,215,232 B2 * 5/2007 Aoki ..... H01F 27/292 336/83
7,495,538 B2 * 2/2009 Tsunemi ..... H01F 3/10 336/84 M
9,312,061 B2 * 4/2016 Takagi ..... H01F 27/263
9,852,839 B2 * 12/2017 Takagi ..... H01F 27/327
10,418,174 B2 * 9/2019 Mikogami ..... H01F 27/2828
10,770,219 B2 * 9/2020 Kawasaki ..... H01F 5/00
11,101,062 B2 * 8/2021 Aoki ..... H01F 41/127
2003/0071704 A1 * 4/2003 Toi ..... H01F 27/36 336/83
2008/0055034 A1 * 3/2008 Tsunemi ..... H01F 3/10 336/83
2008/0224813 A1 * 9/2008 Hirai ..... H01F 17/045 336/216
2010/0045418 A1 * 2/2010 Nishikawa ..... H01F 17/045 336/206
2014/0167903 A1 * 6/2014 Tomonari ..... H01F 17/045 336/220
2016/0358710 A1 * 12/2016 Yamakita ..... H01F 27/292
2016/0365191 A1 12/2016 Horie et al.
2017/0025212 A1 1/2017 Jerez et al.
2017/0229230 A1 8/2017 Kawasaki et al.
2018/0019046 A1 * 1/2018 Miyamoto ..... H01F 3/14
2018/0182528 A1 * 6/2018 Miyamoto ..... H01F 27/292

FOREIGN PATENT DOCUMENTS

JP 2003086442 A * 3/2003 ..... H01F 27/29
JP 2004-363178 A 12/2004
JP 2009-302321 A 12/2009
JP 2017-005079 A 1/2017
JP 2017-508298 A 3/2017
JP 2017-143121 A 8/2017

* cited by examiner

COIL COMPONENT AND METHOD FOR MANUFACTURING COIL COMPONENT

CROSS-REFERENCE TO RELATED APPLICATION

This application claims benefit of priority to Japanese Patent Application No. 2018-014093, filed Jan. 30, 2018, the entire content of which is incorporated herein by reference.

BACKGROUND

Technical Field

The present disclosure relates to a wire-wound coil component and a method for manufacturing the coil component.

Background Art

One example of a wire-wound coil component includes a drum core including flange portions on opposite sides of a winding core portion in its axial direction, a wire wound around the winding core portion, and a sheet core arranged on a top surface of each of the flange portions with an adhesive interposed therebetween. As the adhesive, a resin containing filler is typically used, as described in Japanese Unexamined Patent Application Publication No. 2009-302321.

SUMMARY

In the future, when the coil component is more miniaturized, and thus the area of the top surface of the flange portion is reduced, the area of the adhesive applied is also reduced, and the bonding strength between the sheet core and the flange portion may be insufficient. In like manner, when the profile of the coil component is more reduced and thus the sheet core is slimmed down, it may be difficult to have a sufficient mechanical strength of the sheet core.

When the coil component is more miniaturized, and the area of the top surface of the flange portion is reduced, a high degree of accuracy of may be needed in applying the adhesive. One expected technique for applying the adhesive to address this issue may be the dispenser technique, which uses a dispenser with high accuracy of the application, in place of the dipping technique, whose accuracy of the application is low. In the case where a known adhesive containing filler is used, however, if the adhesive is applied by using a dispenser, a discharge portion is clogged with the filler. Thus, the dipping technique is employed in practice.

Accordingly, the present disclosure provides a coil component capable of improving the bonding strength between a drum core and a sheet core and improving the mechanical strength of the sheet core and a method for manufacturing the coil component.

According to one embodiment of the present disclosure, a coil component includes a drum core, a wire, and a sheet core. The drum core includes a winding core portion and flange portions on opposite sides of the winding core portion in its axial direction. The wire is wound around the winding core portion. The sheet core is arranged on a top surface of each of the flange portions and on the wire with an adhesive interposed therebetween. The adhesive contains no filler. A shortest distance between the top surface of the flange portion and the sheet core is not smaller than about 3 μm. In this configuration, the bonding strength between the drum core and the sheet core and the mechanical strength of the sheet core are improved.

In the above coil component, a shortest distance between the wire and the sheet core may preferably be smaller than about 50 μm. In this configuration, a sufficient stress of the adhesive between the wire and the sheet core can be ensured, and a satisfactory distance between the top surface of the flange portion and the sheet core can be easily ensured.

In the above coil component, the wire may preferably be wound around the winding core portion in multiple layers. In this configuration, the stress of the adhesive between the wire and the sheet core is increased, and a satisfactory distance between the top surface of the flange portion and the sheet core can be easily ensured.

In the above coil component, the sheet core may preferably have a thickness of not more than about one-third of a height of the coil component including the thickness of the sheet core. In this configuration, the advantage of improving the mechanical strength of the sheet core is further effective.

In the above coil component, the thickness of the sheet core may preferably be not more than about 200 μm. In this configuration, the advantage of improving the mechanical strength of the sheet core is further effective.

In the above coil component, the sheet core may preferably be a resin sheet containing magnetic powder. In this configuration, the advantage of improving the mechanical strength of the sheet core is further effective.

In the above coil component, the adhesive on the top surface of the flange portion and the adhesive on the wire may preferably be integrated. In this configuration, the bonding strength between the drum core and the sheet core and the mechanical strength of the sheet core are further improved.

In the above coil component, the adhesive on the top surface of the flange portion may preferably be more extended than the adhesive on the wire in a width direction. In this configuration, if the adhesive is excessively applied, the excess adhesive is absorbed into the adhesive near the wire, and leakage of the adhesive to the side surfaces of the sheet core or the flange portion is suppressed.

According to another embodiment of the present disclosure, a method for manufacturing a coil component including a drum core including a winding core portion around which a wire is wound and flange portions on opposite sides of the winding core portion in its axial direction is provided. The method includes applying an adhesive containing no filler to the sheet core, after the applying, arranging the sheet core on each of top surfaces of the flange portions and on the wire such that the adhesive is interposed therebetween, and after the arranging, curing the adhesive such that a shortest distance between the top surface of the flange portion and the sheet core is not smaller than about 3 μm. With this method, the bonding strength between the drum core and the sheet core and the mechanical strength of the sheet core can be improved.

In the above method for manufacturing the coil component, in the applying, the adhesive may preferably be applied at substantially four corner portions and a substantially central portion of the sheet core, the substantially four corner portions facing the top surfaces of the flange portions, the substantially central portion facing the wire. When the sheet core is arranged on the top surfaces of the flange portions and the wire by this method, sections of the adhesive applied at the five spots are pressed and spread, and they become integrated. Accordingly, the bonding strength between the drum core and the sheet core and the mechanical strength of the sheet core are improved.

In the above method for manufacturing the coil component, in the applying, a width of the adhesive applied to the substantially central portion of the sheet core may preferably be smaller than a sum of widths of the adhesive applied to the substantially four corner portions of the sheet core. With this method, if the adhesive is excessively applied, the excess adhesive is absorbed into the adhesive near the wire, and leakage of the adhesive to the side surfaces of the sheet core or the flange portion is suppressed.

In the above method for manufacturing the coil component, in the applying, the adhesive may preferably be applied by using a dispenser. In this method, the accuracy of applying the adhesive is improved.

According to the coil component and the method for manufacturing the coil component of the present disclosure, the bonding strength between the drum core and the sheet core and the mechanical strength of the sheet core can be improved.

Other features, elements, characteristics and advantages of the present disclosure will become more apparent from the following detailed description with reference to the attached drawings.

DETAILED DESCRIPTION

Some embodiments of the present disclosure are described below with reference to the drawings. A coil component 1 illustrated in FIG. 1 includes a drum core 2, two wires 3*a* and 3*b*, and a sheet core 13. One example of the coil component 1 is a common-mode choke coil.

A material of the drum core 2 is an electrical insulating material. Examples of the material may include non-magnetic materials, including aluminum oxide, glass, and resin, and magnetic materials, including ferrite and resin containing magnetic powder. Preferably, the material may be aluminum oxide, glass, or a sinter, such as ferrite.

Figure 1:
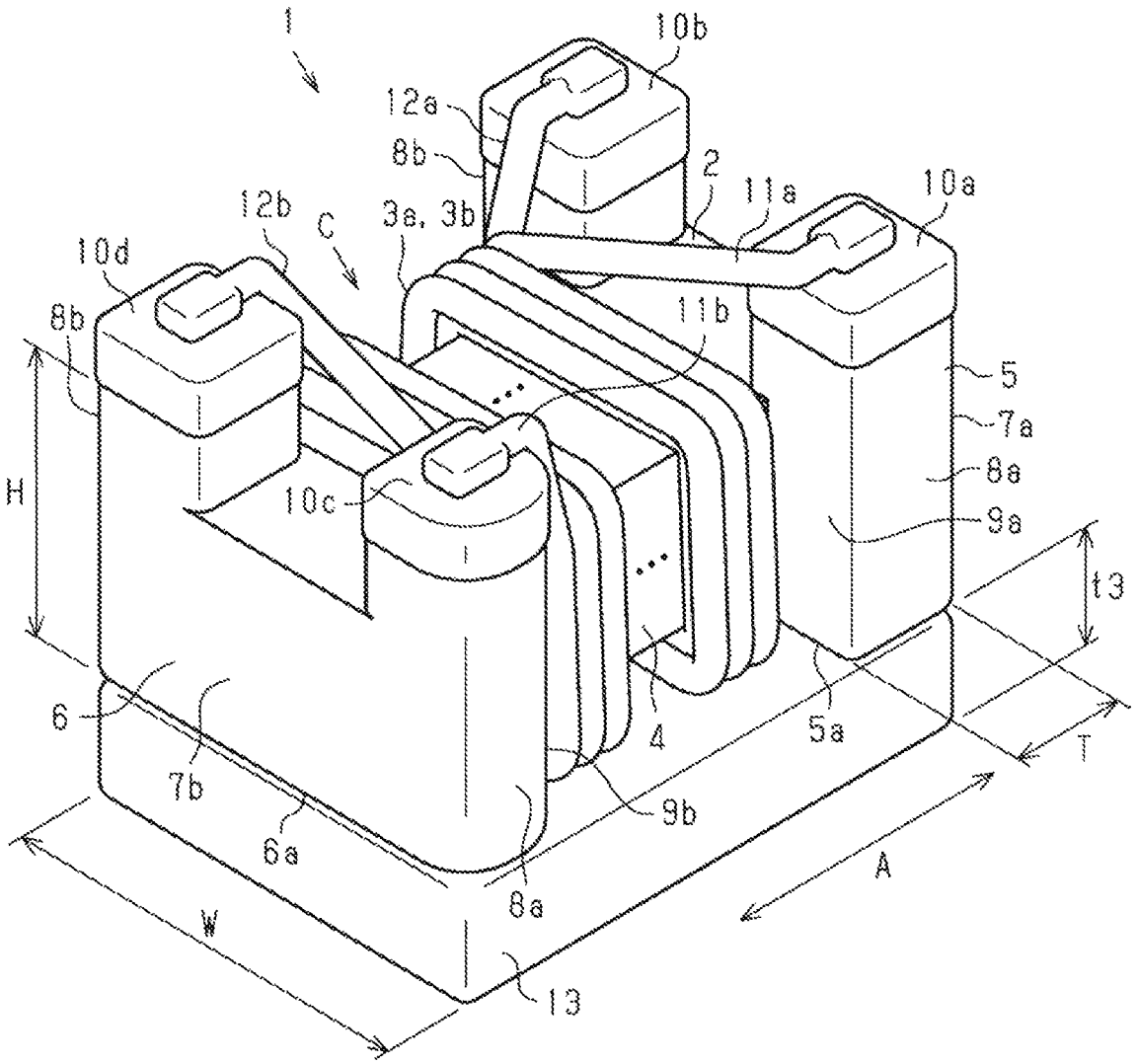
FIG. 1 is a perspective view that illustrates a coil component.

The drum core 2 includes a winding core portion 4 having a substantially quadrangular prism shape and a first flange portion 5 and a second flange portion 6 on opposite sides of the winding core portion 4 in an axial direction of the winding core portion 4 (direction in which the winding core portion 4 extends; in FIG. 1, the direction indicated by the arrow A). The winding core portion 4 and the flange portions 5 and 6 are integrated. Each of the flange portions 5 and 6 has a width W and a height H, which are larger than the width and height of the winding core portion 4, respectively, and a thickness T, which is smaller than the axial length of the winding core portion 4, and has a flange shape for the winding core portion 4.

The flange portions 5 and 6 have outer side surfaces 7*a* and 7*b*, respectively, positioned on their outer side portions in the axial direction of the winding core portion 4 and inner side surfaces 9*a* and 9*b*, respectively, positioned on their inner side portions in the axial direction. Each of the flange portions 5 and 6 has a first side surface 8*a* and a second side surface 8*b*. The first side surface 8*a* and second side surface 8*b* are positioned on opposite sides in the axial direction of each of the outer side surfaces 7*a* and 7*b* and are substantially perpendicular to the outer side surfaces 7*a* and 7*b*. In the present disclosure, the width direction indicates a direction that is substantially perpendicular to the axial direction A and that is substantially parallel to a principal surface of a circuit board when the coil component 1 is mounted on the circuit board.

Terminal electrodes 10*a* to 10*d* are disposed on the bottom surfaces of the flange portions 5 and 6 (upper surface in FIG. 1) on opposite sides in the width direction. The terminal electrodes 10*a* to 10*d* are disposed on projections in the bottom surfaces of the flange portions 5 and 6 and may be formed by, for example, baking conductive paste containing silver as its conductive component and, as needed, applying plating of nickel, copper, tin, or the like thereon. In place of this, the terminal electrodes 10*a* to 10*d* may be terminal fittings made of a conductive metal bonded to the flange portions 5 and 6.

Each of the wires 3*a* and 3*b* may be formed of a copper wire with insulating coating of a resin, such as polyurethane or polyimide. Two layers of the wires 3*a* and 3*b* spirally wound around the winding core portion 4 form a coil C. A first end 11*a* of the wire 3*a* is connected to the terminal electrode 10*a*, and a second end 11*b* thereof is connected to the terminal electrode 10*c*. A first end 12*a* of the wire 3*b* is connected to the terminal electrode 10*b*, and a second end 12*b* thereof is connected to the terminal electrode 10*d*. The terminal electrodes 10*a* to 10*d* and the wires 3*a* and 3*b* may be connected by, for example, thermocompression bonding. That connection may be achieved by welding.

The top surface (lower surface in FIG. 1) of the drum core 2 opposite to the bottom surface on which the terminal electrodes 10*a* to 10*d* are disposed is bonded to the sheet core 13 with an adhesive 14. The sheet core 13 may be made of the same or similar material of the drum core 2, and its thickness t3 may preferably be not more than about one-third of the height of the coil component 1 in which the sheet core 13 is bonded to the flange portions 5 and 6. As illustrated in FIG. 1, the sheet core 13 is a substantially rectangular parallelepiped sheet structure that covers top surfaces 5*a* and 6*a* of the flange portions 5 and 6 and a region above the winding core portion 4 between the flange portions 5 and 6, and its thickness may preferably be not more than about 200 μm. The sheet core 13 may not be a sinter, may be a resin sheet formed from a resin, or may also be a resin sheet containing magnetic powder. For this configuration, in which a profile reduction of the coil component 1 can be achieved, but the mechanical strength of the sheet core 13 tends to decrease relatively, the advantage of improving the mechanical strength of the sheet core 13 described below is further effective.

The bonding configuration of the sheet core 13 is described below.

Figure 2:
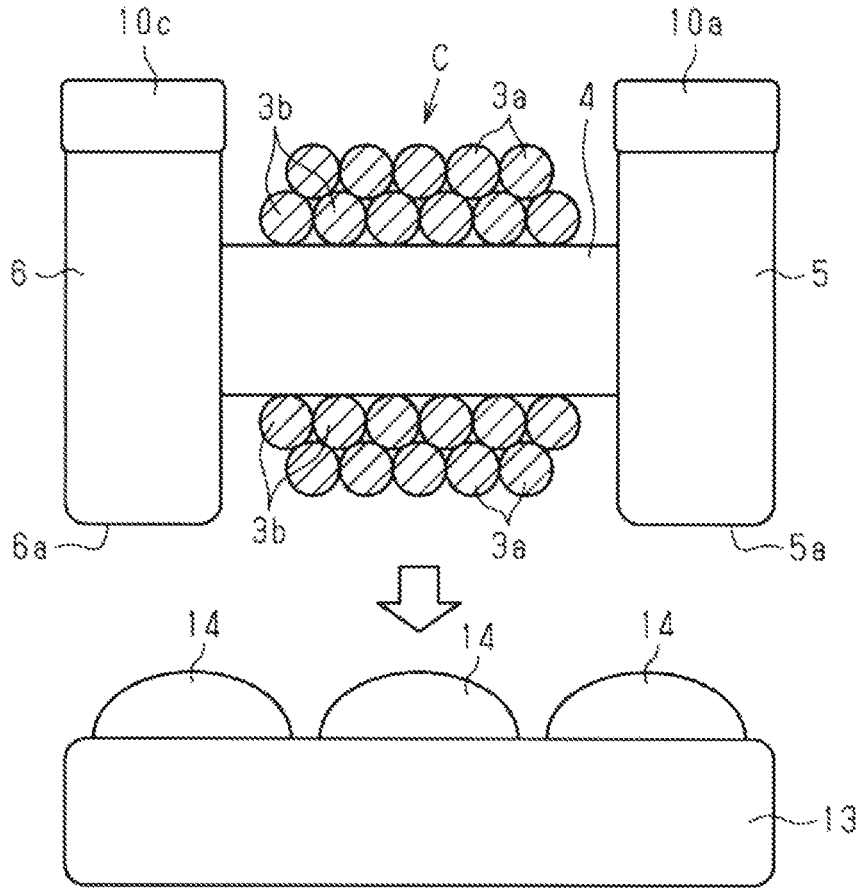
FIG. 2 is a side view that illustrates a state before a sheet core and each of a drum core and wires are bonded.
Figure 3:
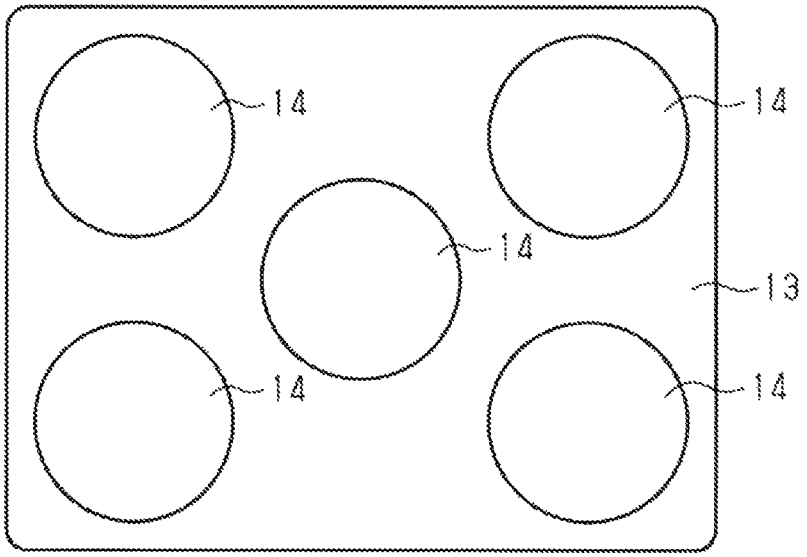
FIG. 3 is a bottom view that illustrates the sheet core with an adhesive applied thereto.

As illustrated in FIGS. 2 and 3, the adhesive 14 is applied to the lower surface of the sheet core 13, that is, the surface facing the drum core 2. As the adhesive 14, a material that contains no filler, such as silica, is used. In terms of improvement in the accuracy of application, the adhesive 14 may preferably be applied by using a dispenser, but the method of applying the adhesive 14 is not limited to a particular one.

Figure 4:
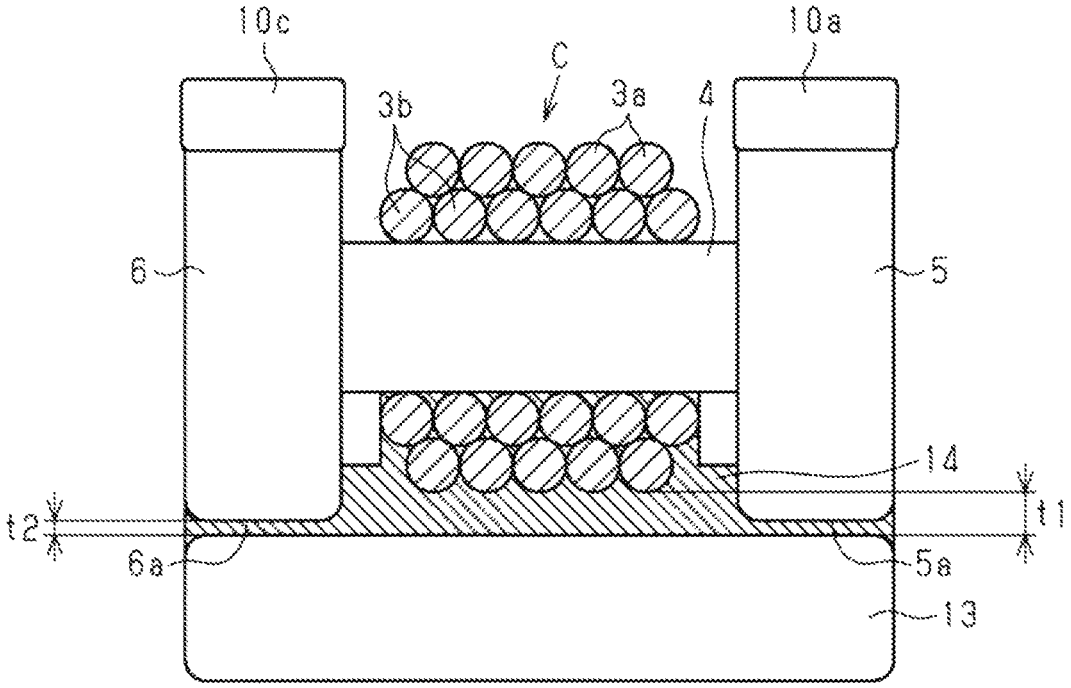
FIG. 4 is a side view that illustrates a state after the sheet core and each of the drum core and the wires are bonded.

As illustrated in FIG. 3, the adhesive 14 is applied at five spots of spots near the corners and a spot in the substantially central portion of the sheet core 13. When the sheet core 13 with the adhesive 14 applied thereto is pressed to the top surfaces 5*a* and 6*a* of the flange portions 5 and 6 and the coil C, the state is the one in which the adhesive 14 is charged on the sheet core 13, the top surfaces 5*a* and 6*a* of the flange portions 5 and 6, and the wires 3*a* and 3*b*, as illustrated in FIG. 4. Then, the sheet core 13 can be arranged on each of the top surfaces 5*a* and 6*a* of the flange portions 5 and 6 and the wires 3*a* and 3*b* with the adhesive 14 interposed therebetween. After this arrangement, the adhesive 14 is cured by drying, heating, or other processing, the sheet core 13 is bonded to the drum core 2, and thus the sheet core 13 is arranged on the top surfaces 5*a* and 6*a* and the wires 3*a* and 3*b* with the adhesive 14 interposed therebetween. In this configuration, in comparison with a known configuration in which the sheet core 13 is arranged such that the adhesive 14 is interposed only between the sheet core 13 and the top surfaces 5*a* and 6*a* of the flange portions 5 and 6, the area of the adhesive 14 applied is increased by the amount corresponding to the region on the wires 3*a* and 3*b*, and the bonding strength between the drum core 2 and sheet core 13 is improved. In this configuration, in comparison with the known configuration, in which the sheet core 13 is supported only on the top surfaces 5*a* and 6*a* of the flange portions 5 and 6, the sheet core 13 is supported in a wider region including the region on the wires 3*a* and 3*b*, and thus the mechanical strength of the sheet core 13 is also improved.

Here, the shortest distance t2 between the top surfaces 5*a* and 6*a* of the flange portions 5 and 6 and the sheet core 13 (gap between the flat surface of the top surfaces 5*a* and 6*a* and the flat surface of the lower surface of the sheet core 13 in FIG. 4) is not smaller than about 3 μm. Typically, the shortest distance t2 is not dependent on pressing of the sheet core at the time of bonding, but depends on the presence or absence of filler in the adhesive 14. If the adhesive 14 contains filler, as in known examples, because the filler is a spacer, the shortest distance t2 is determined by the grain size and content of the filler. Here, as in the coil component 1, due to the stress of the adhesive 14 between the sheet core 13 and the coil C, the distance t2 between the sheet core 13 and the top surfaces 5*a* and 6*a* of the flange portions 5 and 6 is not smaller than about 3 μm.

In the coil component 1, the adhesive 14 contains no filler, and the shortest distance t2 between the top surfaces 5*a* and 6*a* of the flange portions 5 and 6 and the sheet core 13 is not smaller than about 3 μm. The shortest distance t2 is a minute gap, does not depend on the amount or time of pressing of the sheet core 13, and is dominantly determined by the physical properties of the adhesive 14. If the adhesive 14 contains filler, as in known examples, the shortest distance t2 is subject to the grain size and the content (density) of the filler.

Here, in the coil component 1, as described above, because the adhesive 14 is applied to not only the top surfaces 5*a* and 6*a* but also the wires 3*a* and 3*b*, the adhesive 14 on the wires 3*a* and 3*b* moves onto the top surfaces 5*a* and 6*a* of the flange portions 5 and 6 at the time of pressing of the sheet core 13, and thus the amount of the adhesive 14 on the top surfaces 5*a* and 6*a* is increased. Accordingly, if the adhesive 14 contains filler, the content of the filler on the top surfaces 5*a* and 6*a* is relatively large, and the shortest distance t2 is too long. Because the shortest distance t2 has effect on the magnetic resistance in a magnetic path where a magnetic flux produced by the coil C passes through the drum core 2 and sheet core 13, if the shortest distance t2 is too long, the inductance value of the coil component 1 decreases, and necessary characteristics are not obtainable. Thus, in the coil component 1, the adhesive 14 does not contain filler, and this can suppress an excessive increase in the shortest distance t2.

When the adhesive 14 does not contain filler, the shortest distance t2 may be significantly small. The present inventor, however, found that if the shortest distance t2 is minutely small, in particular, below 3 μm, variations in the inductance value caused by variations in the shortest distance t2 are significantly large, and in order to fall within tolerance for the inductance value, the yield of mass-produced items markedly decreases. Accordingly, for the coil component 1, the inductance value is stabilized by setting the shortest distance t2 at a value not smaller than about 3 μm, and practical quality allowing mass production is achieved. When the adhesive 14 contains no filler, the shortest distance t2 can be adjusted by adjustment of the material of the adhesive 14 and the amount of the adhesive 14 applied to the sheet core 13.

As described above, in the coil component 1, the sheet core 13 is arranged on each of the top surfaces 5*a* and 6*a* of the flange portions 5 and 6 and the wires 3*a* and 3*b* with the adhesive 14 interposed therebetween, and in addition, the adhesive 14 contains no filler and the shortest distance t2 between the top surfaces 5*a* and 6*a* of the flange portions 5 and 6 and the sheet core 13 is not smaller than about 3 μm. Hence, practical quality allowing mass production is achieved, and in addition, the bonding strength between the drum core 2 and sheet core 13 can be improved, and the strength of the sheet core 13 can be improved.

In this case, the shortest distance t1 between the wires 3*a* and 3*b* and the sheet core 13 (gap between the outer edge of the wires 3*a* and 3*b* and the lower surface of the sheet core 13 in FIG. 4) may preferably be smaller than about 50 μm. The shortest distance t1 is adjusted by adjustment of the amount of the adhesive 14 applied to the sheet core 13.

Typically, the shortest distance t2 is adjusted by setting the material of the adhesive 14 and the amount of the adhesive 14 applied to the sheet core 13. In the above-described configuration, however, because it has been found that, independently of the material of the adhesive 14, a satisfactory stress of the adhesive 14 between the wires 3*a* and 3*b* and the sheet core 13 can be ensured and the shortest distance t2 can be set at not smaller than about 3 μm, a satisfactory shortest distance t2 between the top surfaces 5*a* and 6*a* of the flange portions 5 and 6 can be easily ensured.

Figure 5:
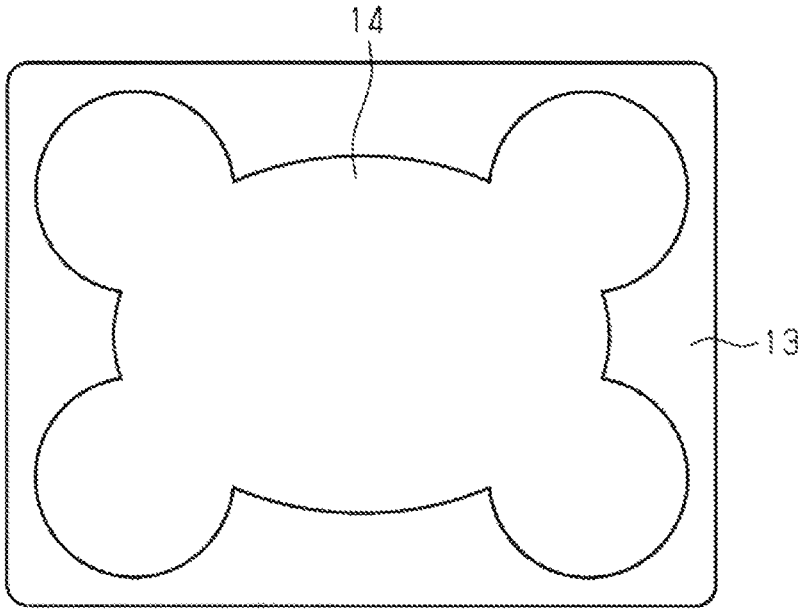
FIG. 5 is a bottom view that illustrates a state of the adhesive when the sheet core is bonded to flange portions.

The adhesive 14 on the top surfaces 5*a* and 6*a* of the flange portions 5 and 6 and the adhesive 14 on the wires 3*a* and 3*b* may preferably be integrated with each other. For example, in the coil component 1, the adhesive 14 applied at five spots on the lower surface of the sheet core 13 is pressed against the flange portions 5 and 6 and the wires 3*a* and 3*b*, and the sections of the adhesive 14 at the five spots are pressed and spread, and they become integrated, as illustrated in FIG. 5. In this configuration, the advantage of improving the mechanical strength of the sheet core 13 is further effective. In this case, because the position where the adhesive 14 is applied to the substantially central portion of the sheet core 13 at the time of applying the adhesive 14 is inside a pair of positions where the adhesive is applied in four corner portions of the sheet core 13 in the width direction, the pressed adhesive 14 can be easily extended toward the substantially central portion of the lower surface of the sheet core 13. The adhesive 14 may be integrally applied in an area illustrated in FIG. 5 by using a dispenser from the beginning.

The shape of winding the wires 3*a* and 3*b* around the winding core portion 4 is not particularly limited. The wires 3*a* and 3*b* may preferably be wound in multiple layers, as in the coil component 1. In this configuration, the gap between the wires 3*a* and 3*b* and the sheet core 13 is further reduced, and thus, the stress of the adhesive 14 is increased, and a satisfactory shortest distance t2 between the top surfaces 5*a* and 6*a* of the flange portions 5 and 6 and the sheet core 13 can be easily ensured.

The shape of applying the adhesive 14 on the lower surface of the sheet core 13 is not particularly limited. As in the coil component 1, the width of the adhesive 14 applied to the substantially central portion of the sheet core 13 may be smaller than the sum of the widths of the adhesive 14 applied to the four corner portions of the sheet core 13 by, for example, applying the adhesive 14 to the substantially central portion and four corner portions on the lower surface of the sheet core 13. With this manner, in the coil component 1, the adhesive 14 on the top surfaces 5*a* and 6*a* of the flange portions 5 and 6 may preferably be more extended than the adhesive 14 on the wires 3*a* and 3*b* in the width direction. In this configuration, if the adhesive 14 is excessively applied, the excess adhesive 14 is absorbed into the adhesive 14 near the wires 3*a* and 3*b*, and leakage of the adhesive 14 to the side surfaces of the sheet core 13 or the flange portions 5 and 6 is suppressed.

The advantages obtainable from the above coil component 1 are described below.

(1) Because the sheet core 13 is bonded to the top surfaces 5*a* and 6*a* of the flange portions 5 and 6 of the drum core 2 and the wires 3*a* and 3*b* wound around the winding core portion 4 with the adhesive 14, the bonding strength of the drum core 2 and sheet core 13 and the mechanical strength of the sheet core 13 can be improved. Because the shortest distance t2 between the top surfaces 5*a* and 6*a* of the flange portions 5 and 6 and the sheet core 13 is not smaller than about 3 μm, the inductance value can be stabilized.

(2) Because the adhesive 14 contains no filler, an excessive large value of the shortest distance t2 between the top surfaces 5*a* and 6*a* of the flange portions 5 and 6 and the sheet core 13 can be suppressed. By adjustment of the amount of the adhesive 14 applied to the sheet core 13, the shortest distance t2 can be adjusted. Accordingly, the inductance value can be easily adjusted.

(3) When the amount of the adhesive 14 applied to the sheet core 13 is adjusted such that the shortest distance between the wires 3*a* and 3*b* and the sheet core 13 is not more than about 50 μm, the shortest distance t2 can be easily made not smaller than about 3 μm by the stress of the adhesive 14 between the wires 3*a* and 3*b* and the sheet core 13.

(4) The wires 3*a* and 3*b* are wound around the winding core portion 4 in multiple layers, and thus the gap between the wires 3*a* and 3*b* and the sheet core 13 is further narrowed. Accordingly, the stress of the adhesive 14 can be increased, and a satisfactory shortest distance t2 between the top surfaces 5*a* and 6*a* of the flange portions 5 and 6 and the sheet core 13 can be easily ensured.

(5) Because the mechanical strength of the sheet core 13 is improved, the thickness t3 of the sheet core 13 can be easily made not more than about one-third of the height of the coil component 1 in which the sheet core 13 is bonded to the flange portions 5 and 6, and thus the size and profile of the coil component 1 can be easily reduced and the inductance value of the coil component 1 can be improved.

(6) Because the mechanical strength of the sheet core 13 is improved, the thickness of the sheet core 13 can be easily reduced to not more than about 200 μm, and the size and profile of the coil component 1 can be easily reduced.

(7) When the sheet core 13 is made of a resin sheet containing magnetic powder, in comparison with when it is made of a ceramic material, reducing the thickness and ensuring a satisfactory mechanical strength can be more easily achieved.

(8) Because the sheet core 13 is bonded to the top surfaces 5*a* and 6*a* of the flange portions 5 and 6 and the wires 3*a* and 3*b* between the flange portions 5 and 6 in the state where the adhesive 14 is applied on the lower surface of the sheet core 13 at a total of five spots of the substantially central portion and four corner portions, the sections of the adhesive 14 at the five spots are pressed and spread, and they become integrated. Accordingly, the mechanical strength of the sheet core 13 is improved.

(9) If the adhesive 14 is applied excessively, the excess adhesive 14 is absorbed between the wires 3*a* and 3*b* and the sheet core 13, and leakage to the side surfaces of the sheet core 13 can be suppressed.

(10) Because the sheet core 13 is bonded to the drum core 2 and the wires 3*a* and 3*b* wound around the winding core portion 4 with the adhesive 14 containing no filler, the adhesive 14 can be applied to the sheet core 13 by using a dispenser. Accordingly, the accuracy of applying the adhesive 14 is improved.

The above-described embodiment may be changed. For example, the sheet core may be metal foil.

While some embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a drum core including a winding core portion and flange portions on opposite sides of the winding core portion in an axial direction of the winding core portion;

a wire wound as a coil around the winding core portion; and a sheet core arranged on a top surface of each of the flange portions and on the wire with an adhesive interposed therebetween which contacts the winding core portion, wherein the adhesive contains no filler, a shortest distance between the top surface of the flange portion and the sheet core is not smaller than about 3 μm, opposite outer edges of an inner layer of the coil are spaced from inner surfaces of the flange portions which extend between the respective top surfaces and bottom surfaces of the flange portions, a gap in the adhesive exists in areas between the opposite outer edges of the inner layer of the coil that contacts the winding core portion and the inner surfaces of the flange portions, the adhesive extends continuously between opposite outer edges of a second layer of the coil that is on the inner layer of the coil and the inner surfaces of the flange portions, a number of turns in the second layer of the coil is less than a number of turns in the inner layer of the coil, and each turn in the second layer of the coil contacts two adjacent turns in the inner layer of the coil, and the opposite outer edges of the inner layer of the coil extend beyond the opposite outer edges of the second layer of the coil.

2. The coil component according to claim 1, wherein a shortest distance between the wire and the sheet core is smaller than about 50 μm.

3. The coil component according to claim 2, wherein the wire is wound around the winding core portion in multiple layers including the inner layer.

4. The coil component according to claim 2, wherein the sheet core has a thickness of not more than about one-third of a height of the coil component including the thickness of the sheet core.

5. The coil component according to claim 2, wherein the thickness of the sheet core is not more than about 200 μm.

6. The coil component according to claim 2, wherein the sheet core is a resin sheet containing magnetic powder.

7. The coil component according to claim 2, wherein the adhesive on the top surface of the flange portion and the adhesive on the wire are integrated.

8. The coil component according to claim 7, wherein the adhesive on the top surface of the flange portion is more extended than the adhesive on the wire in a width direction.

9. The coil component according to claim 1, wherein the wire is wound around the winding core portion in multiple layers including the inner layer.

10. The coil component according to claim 1, wherein the sheet core has a thickness of not more than about one-third of a height of the coil component including the thickness of the sheet core.

11. The coil component according to claim 1, wherein the thickness of the sheet core is not more than about 200 μm.

12. The coil component according to claim 1, wherein the sheet core is a resin sheet containing magnetic powder.

13. The coil component according to claim 1, wherein the adhesive on the top surface of the flange portion and the adhesive on the wire are integrated.

14. The coil component according to claim 13, wherein the adhesive on the top surface of the flange portion is more extended than the adhesive on the wire in a width direction.

* * * * *